US006638380B1

(12) United States Patent
De Paepe et al.

(10) Patent No.: US 6,638,380 B1
(45) Date of Patent: Oct. 28, 2003

(54) METHOD FOR MAKING A COLD ROLLED STEEL STRIP FOR DEEP-DRAWING

(75) Inventors: Annick De Paepe, Evegem (BE); Jean Claude Herman, Blégny-Trembleur (BE); Stéphan Wilmotte, Chaudfontaine (BE)

(73) Assignee: Centre de Recherches Metallurgiques, Brussels (BE)

( * ) Notice: Subject to any disclaimer, the term of this patent is extended or adjusted under 35 U.S.C. 154(b) by 0 days.

(21) Appl. No.: 09/856,494

(22) PCT Filed: Oct. 3, 2000

(86) PCT No.: PCT/BE00/00114

§ 371 (c)(1),
(2), (4) Date: Jun. 13, 2001

(87) PCT Pub. No.: WO01/27340

PCT Pub. Date: Apr. 19, 2001

(30) Foreign Application Priority Data

Oct. 13, 1999 (BE) ..... 09900676

(51) Int. Cl.[7] ..... C21D 8/04

(52) U.S. Cl. ..... 148/601; 148/602; 148/603; 148/575

(58) Field of Search ..... 148/601, 602, 148/603, 575

(56) References Cited

U.S. PATENT DOCUMENTS 3,099,592 A 7/1963 Garber ..... 148/144

FOREIGN PATENT DOCUMENTS

| | | | |
|---|---|---|---|
| EP | 0171197 A2 | | 2/1986 |
| EP | 0779370 A1 | | 6/1997 |
| FR | 1542436 | | 7/1965 |
| FR | 2447969 | | 8/1980 |
| JP | 07034136 | * | 2/1995 |

OTHER PUBLICATIONS

Patent Abstracts of Japan, vol. 11, No. 139, May 7, 1987 & JP 61 276935 A (Nippon Steel Corp.), Dec. 6, 1986.

* cited by examiner

*Primary Examiner*—Sikyin Ip
(74) *Attorney, Agent, or Firm*—Jacobson Holman PLLC

(57) ABSTRACT

A method for making a low carbon and low manganese cold rolled steel strip for deep-drawing whereby a steel strip hot rolled in the austenistic region coiled at the end of the high temperature hot rolling process (680° C.<T<750° C.) is subjected to a cold rolling process with a reduction rate between 65 and 80 %, and finally subjected to an annealing and overageing heat treatment. The method consists in heating the steel strip at a heating rate Vh ranging between 150° C./s and 1000° C. up to the annealing temperature Ta ranging between 650° C. and 750° C., and in maintaining it at said annealing temperature for a time interval between 1 and 20 seconds, then in cooling it at cooling rate Vc between 100° C./s and 500° C./s up to an overageing temperature Toa ranging between 150° C. and 450° C.

14 Claims, No Drawings

METHOD FOR MAKING A COLD ROLLED STEEL STRIP FOR DEEP-DRAWING

TECHNICAL FIELD

The present invention relates to a process for manufacturing a cold-rolled steel strip for deep drawing.

STATE OF THE ART

At the present time, steel strips intended for drawing operations are generally cold-rolled steel strips, which have very favourable properties in this respect. However, the manufacture of these cold-rolled strips involves various thickness-reducing and heat-treatment operations which increase their cost.

The use of hot-rolled steel strips for drawing operations, in replacement for conventional cold-rolled strips, is consequently arousing increasing interest, both in terms of manufacture and for users.

It is well known that steels intended for deep drawing are mild steels, that is to say steels whose carbon content is between 0.02% and 0.08% by weight and whose manganese content is between 0.1% and 0.4% by weight.

According to the usual practice, mild steels are hot-rolled in the austenitic region and the temperature at the end of rolling is higher than the conversion temperature Ar3, that is to say a temperature which is generally between 820° C. and 880° C. However, the possibilities for using these conventional hot-rolled strips are very limited, on account of their random texture and their poor drawability. In addition, it is impossible in practice to manufacture hot-rolled thin strips by this conventional method. The reason for this is that the thinness of the strips causes them to cool rapidly, even during hot rolling, such that it is not possible to carry out the finishing rolling in the austenitic region in order to obtain a microstructure that is favourable for the subsequent shaping operations by deep drawing.

Conventional Method Currently Used

At the present time, steels for deep drawing of the type FePO1 and FePO3, the designations relating to the European standard EN 10130, use steels with a low carbon content (0.02<C.<0.08% by weight) and a low manganese content (0.1<Mn<0.4% by weight), which undergo hot is rolling in the austenitic region and are wound at high temperature (680° C.<T<750° C.). These steel strips are then cold-rolled with a reduction ratio of between 65% and 80% and undergo continuous annealing.

Table 1 indicates the minimum mechanical properties required in the context of the two types of commercial steel for deep drawing FePO1 and FePO3.

TABLE 1

Guaranteed mechanical properties for commercial steels for deep drawing.

| Type | YS (MPa) | TS (MPa) | Eltot (%) | R90 |
|---|---|---|---|---|
| FePO1 | ≦280 | 270–410 | ≧28 | — |
| FePO3 | ≦240 | 270–370 | ≧34 | ≧1.3 |

FePO1 and FePO3 are the types of steel as defined in European standard EN 10130 relating to the qualities of commercial steels for deep drawing;

YS (MPa) is the yield strength expressed in megapascals; TS (MPa) is the tensile strength expressed in megapascals;

Eltot (%) is the total elongation at break expressed in

R90 is the Lankford parameter measured at 90° relative to the direction of rolling.

During the abovementioned hot rolling, the winding of the steel strip at a high temperature, that is to say a temperature of between 680° C. and 750° C., is carried out in order to obtain in the hot strip the total precipitation of the N in the form of coarse nitrides, this condition promoting the control of the texture of the strip during the recrystallization annealing.

After cold rolling, the strip undergoes a continuous annealing comprising heating at a rate of about 10° C./s up to an annealing temperature which is in the ferritic region, that is to say less than or equal to 720° C., and maintenance at this temperature for about 1 minute, followed by cooling at a rate of between 10 and 20 C./s down to the overageing temperature. This overageing treatment is necessary in order to obtain a strip whose microstructure comprises a sufficiently small amount of soluble carbon so as to have a small ageing index (AI). In general, the time for which the strip is held at an overageing temperature of between 350° C. and 500° C., which is essential in order to obtain an adequate precipitation of carbides, is several minutes.

Drawbacks of the Abovementioned Conventional Method

A relatively low annealing temperature (<720° C.) which gives rise to a fairly fine-grain microstructure and consequently promotes the presence of nucleation sites for Fe3C. during the slow primary cooling, that is to say from the annealing temperature down to the overageing temperature. The conventional values for the cooling rates in the case of steel strips 0.8 mm thick subjected to a conventional cooling with jets of gas are between 5 and 15° C./s. Consequently, an appreciable amount of C is already precipitated at the start of the overageing treatment, and this results in a harmful smaller supersaturation effect and thus slower carbide precipitation kinetics at the overageing temperature.

An obligation for relatively long maintenance at the overageing temperature, of about from 3 to 5 minutes, which is the consequence of the above comment, but is necessary in order to reduce the amount of interstitial carbon present in the final product to below a value which is low enough to avoid any subsequent ageing.

After a conventional overageing treatment, that is to say with maintenance at 400° C. for 3 to 5 minutes, in a continuous annealing line using the conventional technique of cooling with jets of gas, the ageing index of the product obtained is about 50–60 MPa. Given that a product is defined as being ageing-free when its ageing index is less than 30 MPa (see the following: K. Ushioda et al., Metallurgical Investigation for producing non-ageing deep-drawable LC. AK-steel sheets by continuous annealing, Developments in the annealing of sheet steels, edited by R. Pradhan and I. Gupta, 1992, pp. 261–285), which corresponds to an absence of a flow threshold (Luders strain) in a simulation of ageing in the form of a maintenance at 100° C. for 1 hour. The abovementioned operation of maintenance at 100° C. for 1 hour is representative of a storage operation for 3 months at 30° C. usually carried out in reality by the sheet manufacturer before dispatch to the user. This means that the products thus obtained, and thus also the commercial types FePO1 and FePO3 for deep drawing thus obtained, are sensitive to strain ageing.

PRESENTATION OF THE INVENTION

To avoid the abovementioned drawbacks, the present invention proposes a process for manufacturing a hot-rolled steel strip for deep drawing of the FePO1 and FePO3 type.

In accordance with the invention, a process for manufacturing a cold-rolled steel strip for deep drawing, of between 0.3 mm and 1 mm thick, for application to steels with a low carbon content (0.02<C.<0.08% by weight), a low manganese content (0.1<Mn<0.4% by weight), S<0.015% by weight, Si<0.1% by weight, P<0.08% by weight, Al<0.05% by weight, Nb<0.02% by weight and Ti<0.03% by weight, in which a steel slab of the abovementioned type is subjected to hot rolling in the austenitic region with winding at the end of the hot rolling at high temperature (680° C.<T<750° C.), the said hot-rolled strip being subsequently subjected to cold rolling with a reduction ratio of between 65% and 80%, and finally undergoing a heat treatment of annealing and overageing, is essentially characterized in that the steel strip is heated at a heating rate Vh of between 150° C./s and 1000° C./s up to the annealing temperature Ta of between 650° C. and 750° C., the said strip is maintained at the annealing temperature for a time ta of between 1 and 20 seconds, and the said strip is cooled at a cooling rate Vc of between 100° C./s and 500° C./s down to an overageing temperature Toa of between 150° C. and 450° C.

According to one embodiment of the process, which is the subject of the present invention, the steel strip is heated until it reaches the annealing temperature Ta by induction, preferably by creating a longitudinal induced flux.

Heating the steel strip in this way presents the advantage of great flexibility in the choice of the temperature Ta, and also in the feasibility as regards very high heating rates Vh. In addition, this type of induction heating improves the production efficiency of the process and broadens its field of practical application.

According to another embodiment of the process which is the subject of the present invention, the cooling of the strip from the annealing temperature Ta down to the overageing temperature Toa includes at least one spraying of liquid or a projection of coolant gas onto the strip or the placing of this strip in contact with a chill roll.

The cooling procedure is particularly advantageous when it is desired to achieve a cooling rate that is high enough for the entire process to be able to be carried out in compact lines with high production efficiency.

According to one embodiment of the process which is the subject of the present invention, after annealing, a continuous overageing treatment is carried out by cooling the said strip to an overageing temperature Toa of between 350° C. and 450° C., maintaining the strip at the overageing temperature Toa for a period of between 40 seconds and 2 minutes, and finally cooling it to a temperature below 100° C.

According to another embodiment of the process which is the subject of the present invention, after annealing, the said strip is cooled to an overageing temperature of between 150° C. and 250° C., the said strip is wound up to form reels, which are introduced, at a temperature of between 130° C. and 230° C., into a tunnel furnace under a protective atmosphere to prevent oxidation of the said reels, and the said reels are kept in the said tunnel furnace until they have cooled to a temperature below The above embodiment makes it possible to replace the conventional overageing treatment carried out continuously, that is to say with isothermal maintenance of the travelling strip for 40 seconds to 2 minutes at a temperature of between 350° C. and 450° C., with a non-isothermal alternative treatment of the strip in the form of a reel placed in a tunnel furnace with a non-oxidative protective atmosphere in which it undergoes slow cooling to a temperature below 100° C. during which the soluble carbon precipitates as carbide.

According to another embodiment, after the cooling which follows the respective operation either of overageing with maintenance at the temperature Toa or of passage in the form of reels through a tunnel furnace, the strip is subjected to a "skin pass" rolling operation with a reduction ratio of between 0.5% and 2.5%.

DESCRIPTION OF THE EXAMPLE

The example below shows a comparison between the mechanical properties obtained in the case of a steel strip which has undergone a conventional continuous annealing treatment on the one hand, and an ultra-short annealing (USA) treatment on the other hand, in accordance with the process of the present invention.

The strip is made of aluminium-killed ELC steel comprising a total carbon percentage of 0.032%. The said strip first undergoes hot rolling, followed by cold rolling with a reduction ratio of 75%, and finally continuous annealing followed by overageing.

Table 2 summarizes the data characterizing each of the annealing operations, namely the conventional continuous annealing and the continuous ultra-short annealing USA according to the invention.

TABLE 2 data characterizing the continuous annealing

| ANNEALING | Vh (° C./s) | Ta (° C.) | ta (s) | Vc (° C./s) | Toa (° C.) | toa (s) |
|---|---|---|---|---|---|---|
| Conventional annealing | 10 | 730 | 60 | 20 | 400 | 180 |
| USA | 280 | 710 | 1 | 150 | 450 | 40 |

USA = Ultra-Short Annealing
Vh = heating rate, expressed in ° C./s
Ta = annealing temperature, expressed in ° C.
ta = maintenance time at the annealing temperature, expressed in seconds
Vc = rate of cooling after annealing, expressed in ° C./s
Toa = overageing temperature, expressed in ° C.
toa = maintenance time at the overageing temperature, expressed in seconds Table 3 below gives the mechanical properties of the steel strip after treatment.

TABLE 3

Mechanical properties of the steel strip after annealing and overageing

| ANNEALING | YSl (MPa) | TS (MPa) | YPel (%) | Eltot (%) | R90 | GS (μm) | Ci (ppm) |
|---|---|---|---|---|---|---|---|
| Conventional annealing | 253 | 321 | 8 | 42 | 1.66 | 13 | 25 |
| USA | 234 | 286 | 8 | 42 | 1.62 | 14 | 12 |

USA = Ultra-Short Annealing
YSl = lower yield strength, expressed in megapascals
TS = tensile strength, expressed in megapascals
YPel = yield point elongation, expressed in %
Eltot = total elongation, expressed in %
R90 = Lankford parameter measured at 90° relative to the direction of rolling
GS = grain size, expressed in micrometers
Ci = interstitial carbon content, expressed in ppm It emerges from the values presented in Table 3 that the ultra-short annealing USA according to the invention is milder and it follows therefrom that the strip, after ultra-short annealing, has lower values for YSl (YSl=lower yield strength) and TS (TS=tensile strength) than in the case of a conventional annealing treatment. It follows therefrom that the strip treated by USA annealing satisfies the FePO3 quality standards in terms of drawability, whereas that treated by conventional annealing barely satisfies the FePO1 lower quality standards in the same context. The steel strip treated by ultra-short annealing USA according to the process of the present invention is thus more suitable for undergoing deep drawing operations.

In addition, it should be pointed out that the interstitial carbon content is lower in the strip treated by USA annealing, thus ensuring a lower ageing index, which is an advantage when using the said steel strip. This improvement in the ageing index is associated with a rate of cooling from the annealing temperature in the USA case which is much faster than in a conventional annealing, the effect of which is that a larger amount of carbon is precipitated in the course of the 40 seconds of maintenance during overageing, whereas a more gentle cooling in the conventional annealing leads to a smaller amount of precipitated carbon, even though the duration of maintenance during overageing is substantially longer, in this case 180 seconds.

Conclusions

The process of the invention makes it possible to manufacture steel strips for deep drawing which satisfy the criteria required for suitability in drawing operations in the commercial grade FePO3, with the following additional advantages:

- the steel strip has a lower coefficient of ageing than when conventional continuous annealing processes are carried out;
- the treatment times are shorter, both for annealing and for overageing, which constitutes an appreciable economic advantage in the context of the sizing of industrial installations.

In addition, both the rationalization and the flexibility of the overageing operations may be improved, since the said operations may be physically separated from the continuous process including the annealing, and several reels may be treated simultaneously in the same tunnel furnace.

What is claimed is:

1. Process for manufacturing a cold-rolled steel strip for deep drawing, said strip having a thickness of between 0.3 mm and 1 mm, said process comprising the steps of:

subjecting a steel slab to hot rolling in the austenitic region to obtain a hot-rolled strip, said slab comprising:
a carbon content C: 0.02 wt %<C.<0.08 wt %,
a manganese content Mn: 0.1 wt %<Mn<0.4 wt %,
a sulfur content S: S<0.015 wt %,
a silicon content Si: Si<0.1 wt %,
a phosphor content P: P<0.08 wt %,
an aluminium content Al: Al<0.05 wt %,
a niobium content Nb: Nb<0.02 wt %,
a titanium content Ti: Ti<0.03 wt %, winding said hot-rolled strip at a temperature T: 680° C. <T<750° C., subjecting said hot-rolled strip to cold rolling with a reduction ratio of between 65% and 80%, to obtain a cold-rolled steel strip, heating said cold-rolled steel strip at a heating rate Vh between 150° C./s and 1000° C./s up to an annealing temperature Ta between 650° C. and 750° C., maintaining said strip at said annealing temperature for a time ta between 1 and 20 seconds, and cooling said strip at a cooling rate Vc between 100° C./s and 500° C./s down to an overageing temperature Toa between 350° C. and 450° C., performing a continuous overageing of said steel strip, by maintaining said strip at said overageing temperature for a period of between 40 seconds and 2 minutes, and by cooling said strip to a temperature below 1000° C.

2. Process according to claim 1, wherein the steel strip is heated until the steel strip reaches the annealing temperature Ta by induction.

3. Process according to claim 2, wherein a longitudinal induced flux is used.

4. Process according to claim 1, wherein the cooling of the strip from the annealing temperature Ta to the overageing temperature Toa includes at least one step of spraying liquid onto the strip.

5. Process according to claim 1, wherein the cooling of the strip from the annealing temperature Ta to the overageing temperature Toa includes at least one projection of coolant gas onto the strip.

6. Process according to claim 1, wherein the cooling of the strip from the annealing temperature Ta to the overageing temperature Toa includes at least one placing in contact of the strip with a chill roll.

7. Process according to claim 1, wherein the strip is further subjected to a skin-pass rolling operation with a reduction ratio of between 0.5% and 2.5%.

8. Process for manufacturing a cold-rolled steel strip for deep drawing, said strip having a thickness of between 0.3 mm and 1 mm, said process comprising the steps of:

subjecting a steel slab to hot rolling in the austenitic region, to obtain a hot-rolled strip, said slab comprising:
a carbon content C: 0.02 wt %<C.<0.08 wt %,
a manganese content Mn: 0.1 wt %<Mn<0.4 wt %,
a sulfur content S: S<0.015 wt %,
a silicon content Si: Si<0.1 wt %,
a phosphor content P: P<0.08 wt %,
an aluminium content Al: Al<0.05 wt %,
a niobium content Nb: Nb<0.02 wt %,
a titanium content Ti: Ti<0.03 wt %, winding said hot-rolled strip at a temperature T: 680° C.<T<750° C., subjecting said hot-rolled strip to cold rolling with a reduction ratio of between 65% and 80%, to obtain a cold-rolled steel strip, heating said cold-rolled steel strip at a heating rate Vh between 150° C./s and 1000° C./s up to an annealing temperature Ta between 650° C. and 750° C., maintaining said strip at said annealing temperature for a time ta between 1 and 20 seconds, cooling said strip at a cooling rate Vc between 1000° C./s and 500° C./s down to an overageing temperature Toa between 150° C. and 250° C., and winding up said strip to form reels, wherein said reels are introduced at a temperature of between 130° C. and 230° C. in a tunnel furnace under a protective atmosphere to prevent oxidation of said reels, and keeping said reels in said tunnel furnace until they have cooled to a temperature below 100° C.

9. Process according to claim 8, wherein the steel strip is heated until the steel strip reaches the annealing temperature Ta by induction.

10. Process according to claim 9, wherein a longitudinal induced flux is used.

11. Process according to claim 8, wherein the cooling of the strip from the annealing temperature Ta to the overageing temperature Toa includes at least one step of spraying liquid onto the strip.

12. Process according to claim 8, wherein the cooling of the strip from the annealing temperature Ta to the overageing temperature Toa includes at least one projection of coolant gas onto the strip.

13. Process according to claim 8, wherein the cooling of the strip from the annealing temperature Ta to the overageing temperature Toa includes at least one placing in contact of the strip with a chill roll.

14. Process according to claim 8, wherein the strip is further subjected to a skin-pass rolling operation with a reduction ratio of between 0.5% and 2.5%.

* * * * *